US012473125B2

(12) United States Patent
Chan et al.

(10) Patent No.: US 12,473,125 B2
(45) Date of Patent: Nov. 18, 2025

(54) DRINKING VESSEL WITH STRAW

(71) Applicant: Fitson Singapore Pte. Ltd., Singapore (SG)

(72) Inventors: Ching Chan, Singapore (SG); Kuam Keng Tan, Johor (MY)

(73) Assignee: Fitson Singapore Pte. Ltd., Singapore (SG)

( * ) Notice: Subject to any disclaimer, the term of this patent is extended or adjusted under 35 U.S.C. 154(b) by 201 days.

(21) Appl. No.: 18/248,747

(22) PCT Filed: Sep. 16, 2021

(86) PCT No.: PCT/SG2021/050563

§ 371 (c)(1),
(2) Date: Apr. 12, 2023

(87) PCT Pub. No.: WO2022/081084

PCT Pub. Date: Apr. 21, 2022

(65) Prior Publication Data

US 2023/0382607 A1 Nov. 30, 2023

(30) Foreign Application Priority Data

Oct. 13, 2020 (SG) ..... 10202010133S

(51) Int. Cl.
*B65D 47/04* (2006.01)
*A47G 19/22* (2006.01)
(Continued)

(52) U.S. Cl.
CPC ..... *B65D 47/04* (2013.01); *A47G 19/2222* (2013.01); *A47G 19/2272* (2013.01);
(Continued)

(58) Field of Classification Search
CPC .... B65D 47/04; B65D 41/02; B65D 43/0202; B65D 51/18; B65D 2251/0015;
(Continued)

(56) References Cited

U.S. PATENT DOCUMENTS 3,840,153 A * 10/1974 Devlin ..... B62J 11/04 215/229
5,381,924 A * 1/1995 Kiefel ..... A47G 19/2272 215/229

(Continued)

FOREIGN PATENT DOCUMENTS

EP 2476628 A1 7/2012
WO WO-2008131437 A1 * 10/2008 ..... A47G 19/2266
WO 2017214161 A1 12/2017

OTHER PUBLICATIONS

International Search Report and Written Opinion issued in PCT/SG2021/050563 dated Dec. 22, 2021, 12 pgs.

*Primary Examiner* — Robert J Hicks
(74) *Attorney, Agent, or Firm* — Rothwell, Figg, Ernst & Manbeck, P.C.

(57) ABSTRACT

A drinking vessel including a straw; a lid comprising an opening operable to receive the straw; a container; and a cap operable to be in an open position or a closed position; wherein when the cap is in the open position, the straw is arranged to provide fluid communication between a user and the container through the lid, and wherein when the cap is in the closed position, the straw is urged by the cap into a bent shape such that the straw itself occludes fluid communication.

16 Claims, 16 Drawing Sheets

(51) Int. Cl.
*B65D 41/02* (2006.01)
*B65D 43/02* (2006.01)
*B65D 51/18* (2006.01)

(52) U.S. Cl.
CPC ..... *B65D 41/02* (2013.01); *B65D 43/0202* (2013.01); *B65D 51/18* (2013.01); *B65D 2251/0015* (2013.01); *B65D 2251/0081* (2013.01); *B65D 2543/00046* (2013.01); *B65D 2543/00064* (2013.01); *B65D 2543/00296* (2013.01); *B65D 2543/00351* (2013.01)

(58) Field of Classification Search
CPC .. B65D 2251/0081; B65D 2543/00046; B65D 2543/00064; B65D 2543/00296; B65D 2543/00351; A47G 19/2222; A47G 19/2266; A47G 19/2272
USPC ..... 215/389, 388, 229; 220/708, 707, 705, 220/203.28, 203.01
See application file for complete search history.

(56) References Cited

U.S. PATENT DOCUMENTS

| | | | | |
|---|---|---|---|---|
| 6,523,711 | B1 | 2/2003 | Hughes et al. | |
| 2001/0020623 | A1 | 9/2001 | McDonough et al. | |
| 2006/0102628 | A1* | 5/2006 | Hage | A01K 7/06 220/709 |
| 2014/0069944 | A1* | 3/2014 | Shapiro | A61J 9/006 220/709 |
| 2019/0290037 | A1* | 9/2019 | Wiesman | A47G 21/186 |
| 2020/0352368 | A1* | 11/2020 | Rees | A47G 21/189 |

* cited by examiner

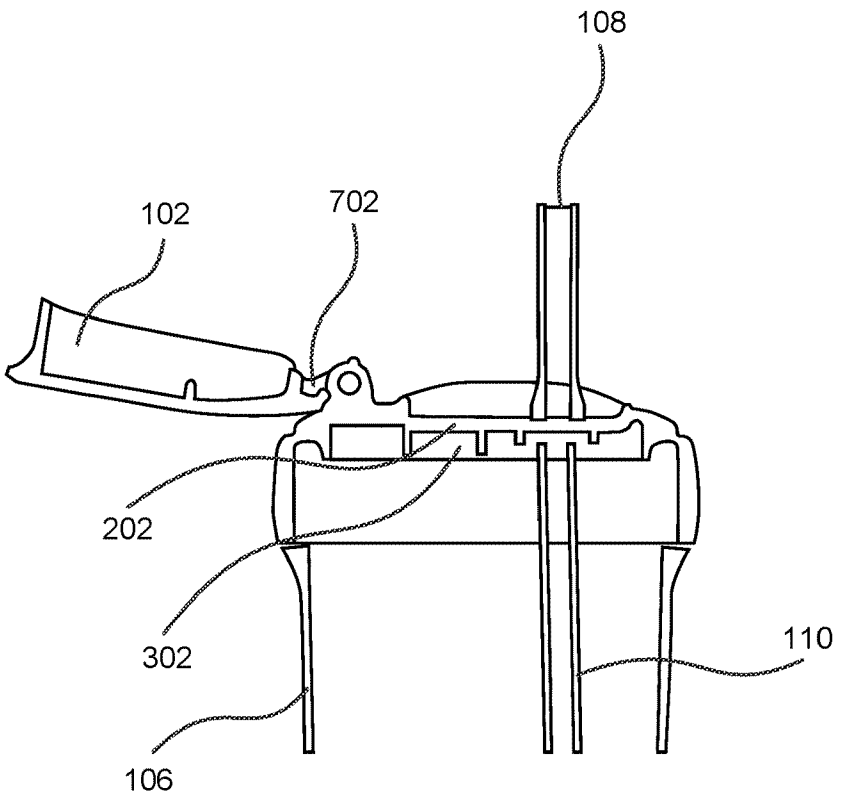
FIG. 7C
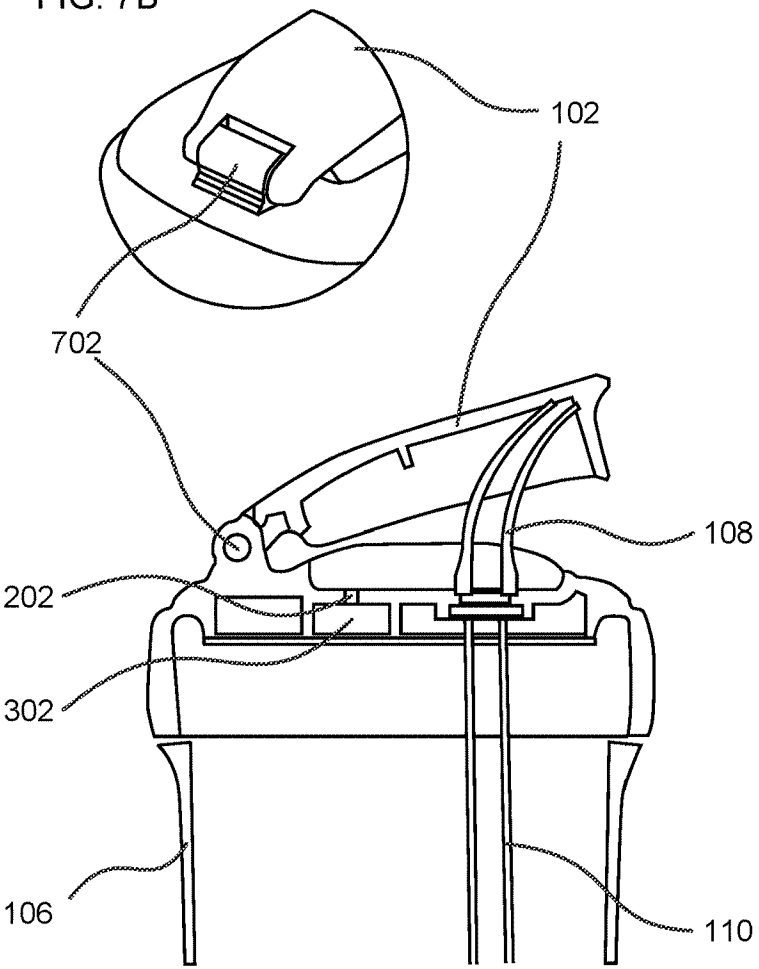
FIG. 7B
FIG. 7A

DRINKING VESSEL WITH STRAW

CROSS REFERENCE TO RELATED APPLICATIONS

This application is a 35 U.S.C. 371 National Phase Entry Application from PCT/SG2021/050563 filed Sep. 16, 2021, which claims priority to and the benefit of Singapore Patent Application No. 10202010133S, filed on Oct. 13, 2020, the disclosures of which are incorporated herein by reference in their entirety.

FIELD OF THE INVENTION

The present disclosure relates to a drinking vessel, such as a water bottle, with a straw to facilitate access to the fluid within.

BACKGROUND

Portable and reusable drinking vessels, such as water bottles, remain popular amongst many users around the world. This is reflective of a conventional desire to remain hydrated while minimising waste and unnecessary spending.

If a vessel is portable, it is also generally undesirable if it were to leak its contents while being transported. Such vessels therefore often either have a lid to bend and press the straw against the body of the vessel tightly enough to prevent the leakage or have a rib to provide a further barrier against leakage.

These drinking vessels can be difficult to maintain and clean, because the drinking vessels are inseparable, which makes it hard to clean or replace when the drinking vessels become tainted or damaged during use or transport. If damaged or otherwise unmaintained, the taste of the liquid being carried can be negatively affected. It is also not environmentally friendly when a portion of the vessel is damaged and the whole drinking vessel must be abandoned.

Some drinking vessels also contain a one-way valve, allowing air to come into the vessels to prevent a vacuum being formed. Air inside of the vessels is not allowed to get out through the one-way valve, and as a result liquids may splash through the straw when the vessels are filled with hot liquids and thus endanger their users.

The examples described herein are not limited to examples which solve problems mentioned in this background section.

SUMMARY

Examples of preferred aspects and embodiments of the invention are as set out in the accompanying independent and dependent claims.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

According to a first aspect of the disclosed technology, there is provided a drinking vessel, comprising: a straw; a lid comprising an opening operable to receive the straw; a container; and a cap operable to be in an open position or a closed position; wherein when the cap is in the open position, the straw is arranged to provide fluid communication between a user and the container through the lid, and further wherein when the cap is in the closed position, the straw is urged by the cap into a bent shape such that the straw itself occludes fluid communication.

In use, a drinking vessel typically comprises a volume of liquid stored in a container and sealed with a lid or cap. Such a seal is formed to prevent leakage of the liquid from the container in transit, for example if the drinking vessel is inverted or shaken. However, forming a seal with a lid, for example a screw-top lid, can provide an impediment to rapid access to the liquid. The lid has to be unscrewed, which can mandate the use of two hands, which can be time consuming or difficult depending on the situation of the user.

Traditional methods to overcome these limitations have involved the use of a cap, which is rotatably attached to the lid and can be put into an "open" position using only a single hand. This may be advantageous for when only a single hand is available, such as during a sport or if a user only has a single hand. Once no more liquid is required by the user, the cap can be put to a "closed" position in order to seal the liquid inside the container. However, the seal formed by the cap abutting the lid may not be sufficient to prevent leakage during handling, transportation, or inversion of the drinking vessel.

Therefore, there is presented herein an apparatus using a straw to substantially form a self-seal preventing the leakage of liquid from the container, wherein it is the straw itself which forms a blockage through which fluid cannot flow. When the cap is in an open position, the straw allows for fluid communication between the container and a user. However, when the cap is in a closed position, the straw is covered by the cap and urged by the cap into a bent shape. The bend in the straw forms an occlusion, preventing the egress of liquid from the container. As long as the cap remains in the closed position, the straw remains blocked and hence liquid cannot leave the container.

Optionally, the drinking vessel further comprises a two-way valve.

A two-way valve may be placed within the drinking vessel, for example within the straw and/or the lid of the drinking vessel. The two-way valve is placed such that it can equalise the pressure of the air between a liquid inside the drinking vessel and the ambient pressure of a user's surroundings.

Optionally, the two-way valve comprises a slit cut into a resilient base material, such that when the pressure on each side of the slit is equal, the base material on each side of the slit meets to form a seal; and when the pressure on each side of the slit is unequal, the base material on each side of the slit is urged apart to allow fluid transmission. Optionally, the length of the slit is 3 to 8 mm. Particularly, the length of the slit is 6 mm.

The resilient base material within which the valve may be cut can have a thickness range from 0.2 to 0.7 mm. The slit can be in a linear straight, curve or cross cut form. It is appreciated that in different embodiments, the valve can be on the main body of the straw 108, or connected with a strap, or separated. Between the lid and the liquid in the container may be a volume of air, for example if some of the liquid has been consumed by a user. If the pressure of the air outside the drinking vessel is greater than the pressure of the air inside the drinking vessel, for example if a user is drinking from the straw, then there is a risk that a vacuum will be formed which will impede the user from drinking more of the liquid. It is therefore advantageous if the pressure can be equalised through a valve. The edges of the valve, also referred to as "lips", may have a triangular cross-section. A lip with a triangular cross-section may provide the advantage of being easier to manufacture. Other cross-sectional shapes may be used when manufacturing that component, for example flat or any other polygonal shape.

Alternatively, if the pressure inside the drinking vessel is greater than the pressure outside the drinking vessel, for example if the liquid being consumed is hotter than the ambient temperature, then it is similarly advantageous if the pressure can be equalised by air flowing in the opposite direction through the valve to avoid rupture of the drinking vessel. If the air pressures inside and outside of the drinking vessel are equal, then any gaps or holes in the valve may provoke leakage of the liquid. Therefore, when the air pressures inside and outside of the drinking vessel are equal, and so no air is required to flow through the valve to equalise the pressures, the valve can substantially block any liquid from passing through and help retain the liquid within the container.

Optionally, the straw comprises one or more structural supports.

Optionally, the one or more structural supports are orientated to urge the straw into the bent shape when pressure is applied from the cap.

It is appreciated that there are many alternative and additional mechanisms through which a straw may be urged into the bent shape. Such mechanisms may include the use of structural ribs an uneven thickness through structural design, and creating a reinforcement feature to help the straw bounce back to its un-bent shape. Further, a crease line or step may be used in the straw to act as guide for bending.

Optionally, the cap has an interior and an exterior surface, and further wherein the interior surface is shaped to urge the straw into the bent shape.

The straw is required to bend in a way that occludes fluid flow through the straw. For example, the straw can be urged to bend in a direction to form a first angle of 45-90°, and then optionally further bend to an approximate opposite direction to form a second angle of 120-180°, to form a substantially self-folded shape. In this example one fold is sufficient to occlude flow therethrough, but in other embodiments more folds may be used, for example 2 or 3 folds. The straw may be urged into a suitable shape through supportive ribs or regions, as a stronger region on one end or side of a straw is likely to urge the straw into a specific shape when pressure is applied. Alternatively or additionally, the inner surface of the cap itself may be shaped so as to guide the straw into a bent position suitable for occluding flow therethrough. For example, the inner surface of the cap may comprise features such as a wall, rib, guide and/or recess that assists the straw to be bent when in contact with said features. The straw tip can comprise a slanted shape or a step to create an initial force to help ensure that it is bent to a desired orientation. When the cap is closed at, for example, approximately 24 degrees, the rib will start to touch and press the front tip of upper straw. This will make the upper straw start to bend inwards at the structural ribs position. Once the cap is fully closed up, for example at zero degrees, the upper straw will be bend approximately 100 to 150 degrees to form a sufficiently strong seal by virtue of the fold itself.

Optionally, the open position comprises a plurality of different positions.

A user may not wish to open the cap fully, nor have the cap loosely swinging from the lid, especially when the drinking vessel is filled with hot liquids where cumulative pressure inside of the vessel may force hot liquids splash through the straw when someone opens the cap. In such cases, a stopper may be provided to resist movement of the cap at certain positions or intervals. For example, the cap may "lock" into place every degrees or at other predetermined positions. Once the cap is in a specific "locked" position, additional force should be required from a user to move the cap from that position, compared to the force required to move the cap from a non-locked position.

Optionally, at least a portion of the straw is made of an elastomer.

Elastomers such as silicone can provide a resilient, non-toxic, and thermally insulating material, safe for use in food and drink utensils. Silicone is a synthetic polymer, and can comprise a combination of silicon, hydrogen, carbon, and/or oxygen. Other elements may be included as well depending on the type of silicone selected. Other materials may be used either separately or in combination, such as other elastomers, paper, and/or thermoplastics.

Optionally, there is provided a seal between the lid and the container.

The likelihood of leaks from the container is increased at any connection between two parts of the drinking vessel. To reduce leakage, a seal may be placed between the lid and the container, optionally in the form of a form of a pliable ring of material such as silicone positioned between the lid and the container. The ring of material is compressed between the lid and the container, providing a more secure barrier against the egress of liquid from the container.

Optionally, there is provided a lower straw between the lid and the container.

In order to access liquid in the container when the supply of liquid is reduced, a user may find it helpful for an additional lower straw to be placed within the container and in fluid communication with the aforementioned (or "upper") straw. The user can then provide suction to the upper straw, which draws liquid from the container through the lower straw, then through the upper straw, and finally to the user themselves.

Optionally, at least a portion of the lower straw and/or seal is made of an elastomer.

Optionally, at least a portion of the cap and/or lid is made of a thermoplastic. Polypropylene (PP) may be used, as can other materials either separately or in combination, such as other thermoplastics, thermosets, and/or elastomers.

Optionally, at least a portion of the container is made of a thermoplastic.

Polyphenylsulfone (PPSU) may be used, as can other materials either separately or in combination, such as other thermoplastics, thermosets, glass, and/or stainless steel.

As described herein, silicone can provide a number of advantageous material properties. Polypropylene (PP) and polyphenylsulfone (PPSU) can provide the required rigidity for some parts of the drinking vessel, while remaining impervious to moisture and chemical damage, and demonstrating sufficient resistance against breaking.

Another aspect of the disclosed technology comprises a two-way valve for use in a drinking vessel, comprising a slit cut into a resilient base material, such that when the pressure on each side of the slit is equal, the base material on each side of the slit meets to form a seal; and when the pressure on each side of the slit is unequal, the base material on each side of the slit is urged apart to allow fluid transmission.

Optionally, at least a portion of the two-way valve is made of silicone. Other materials may be used either separately or in combination, such as elastomers, paper, and/or thermoplastic.

A two-way valve is advantageous in providing a consistently equalised air pressure state between the inside and outside of a drinking vessel. If one side of the valve experiences a higher pressure than the other side, fluid may flow therebetween in order to restore equal pressure. A pressure imbalance can lead to difficulties in using the drinking vessel, or damage to the drinking vessel itself.

Another aspect of the disclosed technology, there is provided a (or upper) straw that is capable of self-sealing, comprising an upper opening, a lower opening, and a straw body with the upper opening located at a first end and the lower opening located at a second end, wherein the straw body close to the lower opening comprises a stronger region, and wherein the straw itself is operable to be urged into a bent shape through external force such that liquid is restricted from passing through the body of the straw.

The lid, the (or upper) straw, the lower straw, the pliable ring and the vessel are separable and independent components of the drinking vessel that can be replaced individually when damaged or unmaintained. When assembling the drinking vessel, the upper opening of the straw will go through the opening of the lid, and be fixed to the lower surface of the lid through a base that receives the lower opening of the straw. The lower straw connects to the lower opening of the straw through the base. The lid is fastened to the vessel with the pliable ring setting in between. The pliable ring may also be referred to as a gasket or a seal. Optionally, the straw forms an independent component. Alternatively, the straw connected to the base forms an independent component. Alternatively, the straw connected to the two-way valve as described herein through the base forms an independent component.

Optionally, the stronger region is composed of one or more structural ribs.

Optionally, the one or more structural ribs are orientated to urge the straw into the bent shape when the external force is applied It will also be apparent to anyone of ordinary skill in the art, that some of the preferred features indicated above as preferable in the context of one of the aspects of the disclosed technology indicated may replace one or more preferred features of other ones of the preferred aspects of the disclosed technology. Such apparent combinations are not explicitly listed above under each such possible additional aspect for the sake of conciseness.

Other examples will become apparent from the following detailed description, which, when taken in conjunction with the drawings, illustrate by way of example the principles of the disclosed technology.

BRIEF DESCRIPTION OF THE DRAWINGS

FIGS. 7A-7C show a cap in two different open positions;

Figure 1B:
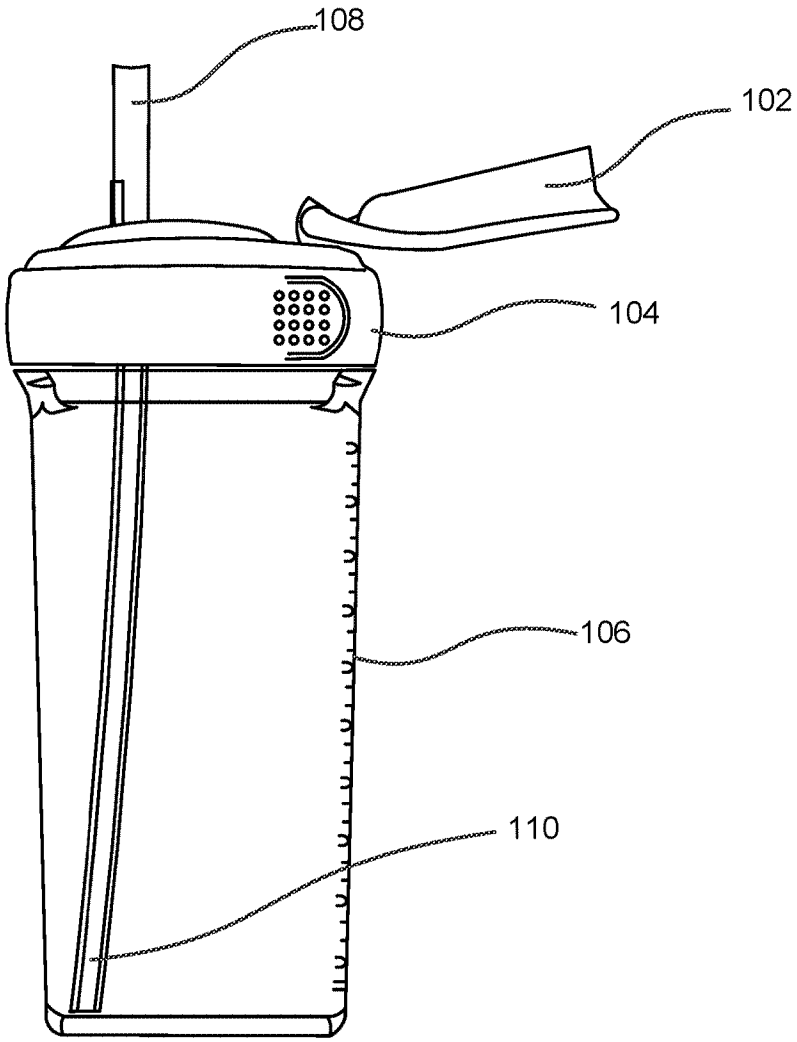
FIGS. 1A and 1B show a side view of an exemplary drinking vessel with a straw.

The accompanying drawings illustrate various examples. The skilled person will appreciate that the illustrated element boundaries (e.g., boxes, groups of boxes, or other shapes) in the drawings represent one example of the boundaries. It may be that in some examples, one element may be designed as multiple elements or that multiple elements may be designed as one element. Common reference numerals are used throughout the figures, where appropriate, to indicate similar features.

DETAILED DESCRIPTION

The following description is made for the purpose of illustrating the general principles of the present technology and is not meant to limit the inventive concepts claimed herein. As will be apparent to anyone of ordinary skill in the art, one or more or all of the particular features described herein in the context of one embodiment are also present in some other embodiment(s) and/or can be used in combination with other described features in various possible combinations and permutations in some other embodiment(s).

Figure 1A:
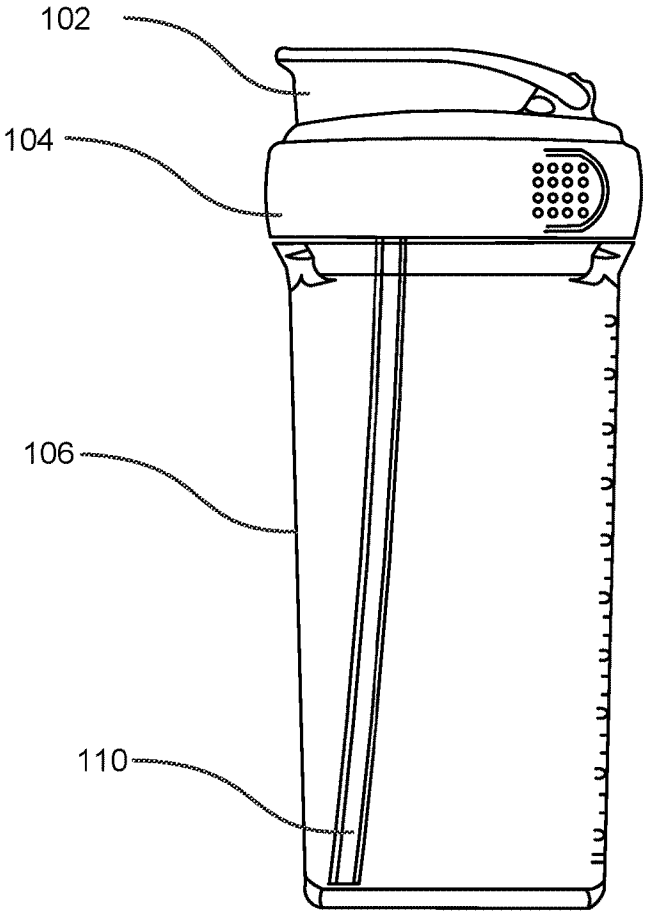

FIGS. 1A and 1B of the accompanying drawings show a side view of an exemplary drinking vessel with a straw. This drinking vessel, also referred to as a bottle, comprises several different parts. In this example, the bottle comprises a cap 102 rotationally linked to a lid 104. The cap 102 is operable to enclose a straw 108, also referred to as an upper straw. The cap 102 may comprise a lip around the edge to allow a user a more secure grip on the cap 102 itself when it is being physically manipulated. The cap 102 may also use a locking mechanism in conjunction with the lid 104, such that when the cap 102 is in a closed position, it is resistant to being opened and separated from the lid 104. This locking mechanism, for example in the form of closely fitting male and female parts, helps the cap 102 to remain closed if accidentally knocked during transit or from the straw 108 pushing it open from within.

In use, the liquid to be accessed by a user may be stored primarily in the container 106, also referred to as the body. A lower straw 110 may be linked to the upper straw 108 such that when suction is applied to the upper straw 108 liquid is pulled through the lower straw 110, to the upper straw 108, and then to the user. When the cap 102 is in an open position, the straw 108 may protrude from the lid 104 by a comfortable amount for an average user to drink from, for example in the range of 20 to 40 mm, optionally 25 mm from the highest rim of the lid 104.

Figure 2B:
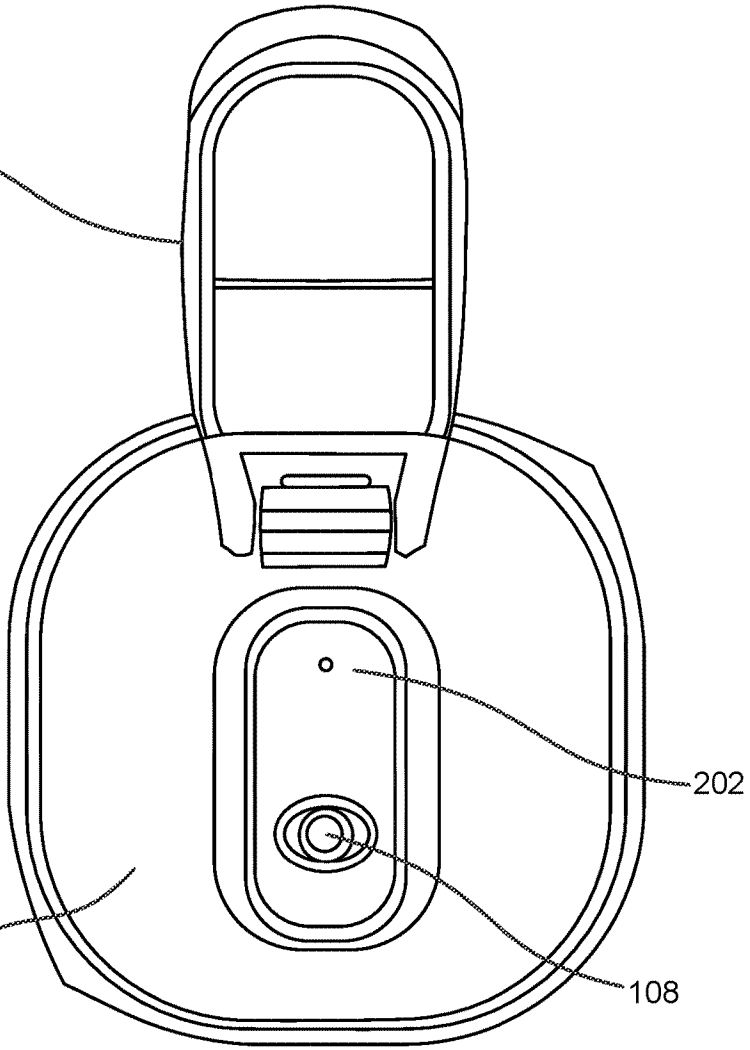
FIGS. 2A and 2B show a plan view of an exemplary drinking vessel with a straw.
Figure 2A:
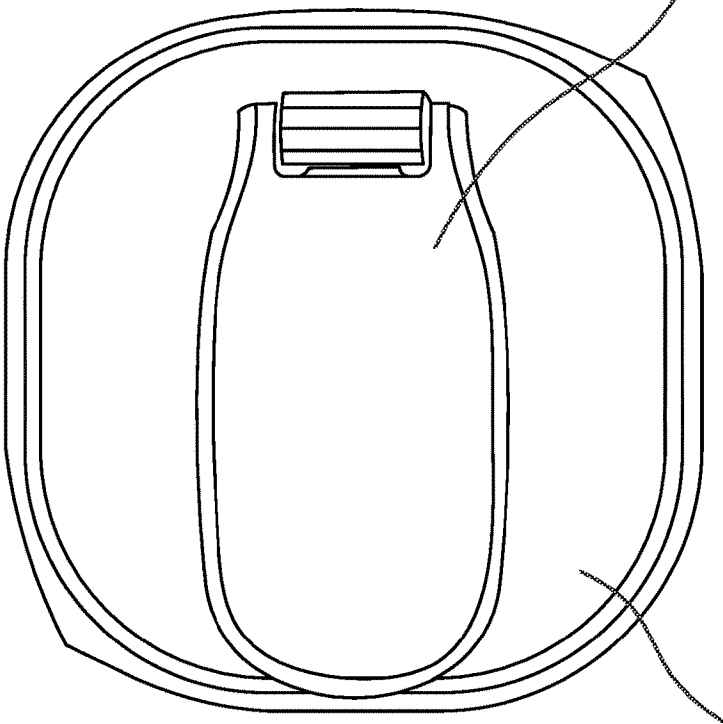

FIGS. 2A and 2B show a plan view of some of the component of FIG. 1. As in relation to that figure, the cap 102 is shown in both a closed and an open position in FIGS. 2A and 2B respectively. There is also shown an air venting hole 202 adjacent the straw. The air venting hole 202 allows the ingress or egress of fluid, typically air, between the inside and outside of the bottle in order to equalise the pressure within the bottle.

Figure 3:
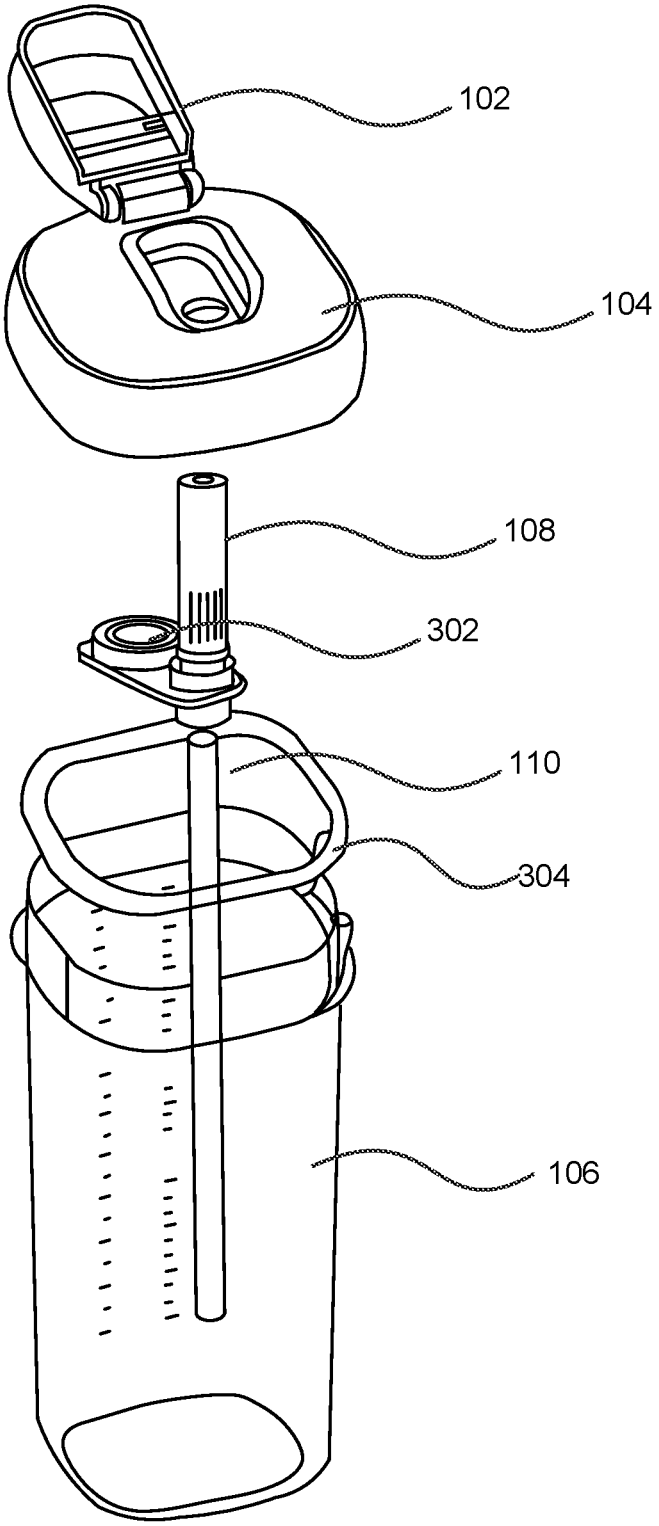
FIG. 3 shows an exploded view.

The exploded view of FIG. 3 shows several of the components of the bottle in one embodiment. The cap 102 is rotationally linked to the lid 104. The lid 104 at least partially accommodates the straw 108, and a two-way valve 302. The two-way valve 302 is arranged to allow the ingress or egress of fluid, typically air, between the inside and outside of the bottle when there is a pressure differential being applied. If the pressure on each side of the two-way valve 302 is equal, then the two-way valve 302 forms a substantially sealed surface which does not allow the passage of fluid.

There is optionally provided a seal 304, also referred to as a gasket, in the form of a pliable ring of material positioned between the lid 104 and the container 106. The seal 304 helps prevent the leakage of liquid between the lid 104 and the container 106.

Figure 4:
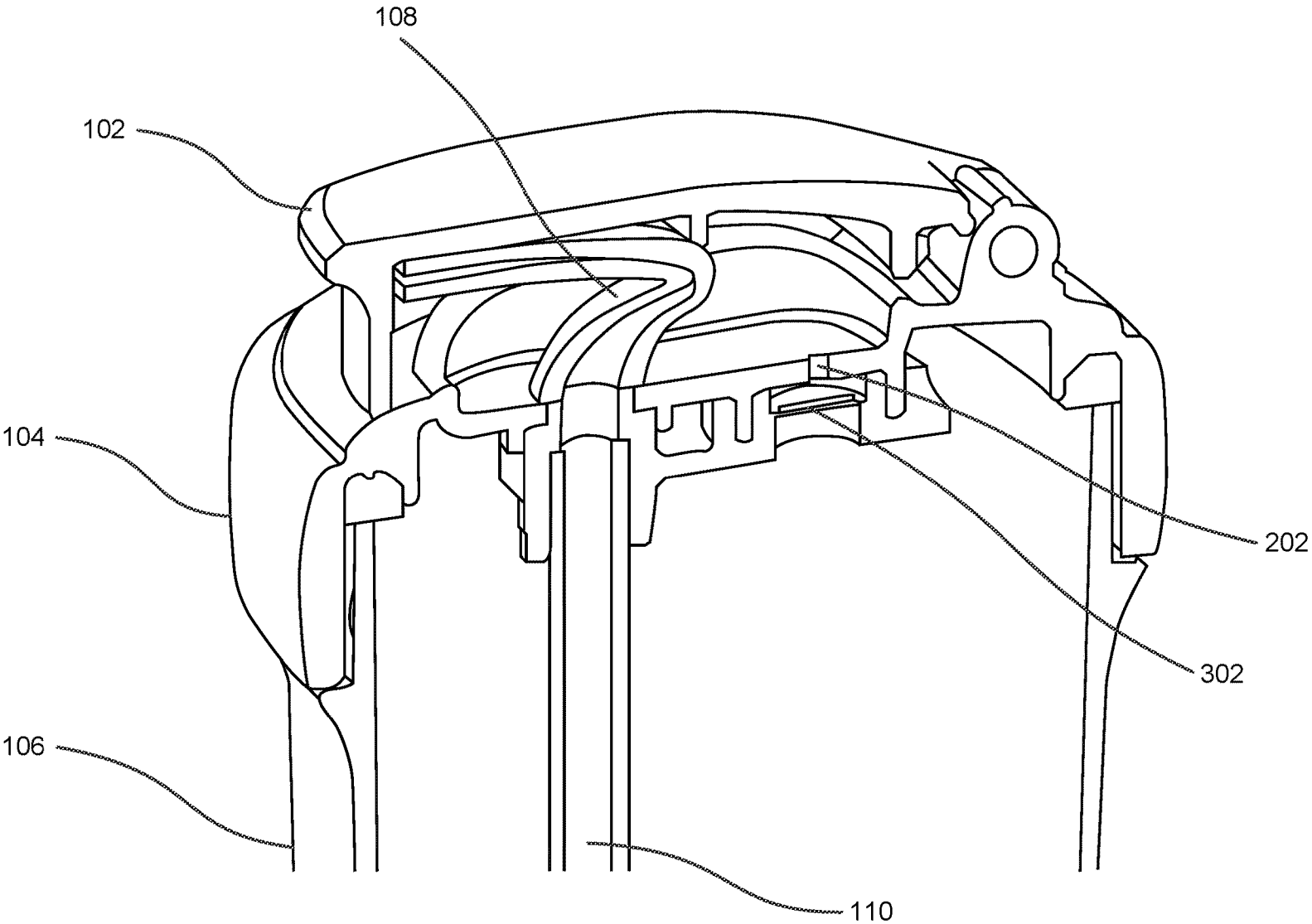
FIG. 4 shows a cap in a closed position.

FIG. 4 shows a more detailed view of the cap 102 in the closed position. When the cap 102 is in this closed position, the straw 108 is urged by the cap 102 into a bent position. In this bent position, the straw 108 comprises at least one bend within which the flow of any fluid through the straw 108 is substantially occluded. Any liquid travelling from the container 106 through the lower straw 110 may pass through a portion of the straw 108, but will be substantially prevented from passing any further than the bend in the straw 108. There is no requirement for a rib or ridge to be present at the folding line to guide the straw 108 or the assist with forming an occlusion within the straw 108. However, a rib guide may be present to act as initial guide to press the straw bend towards a predetermined position.

Figure 5C:
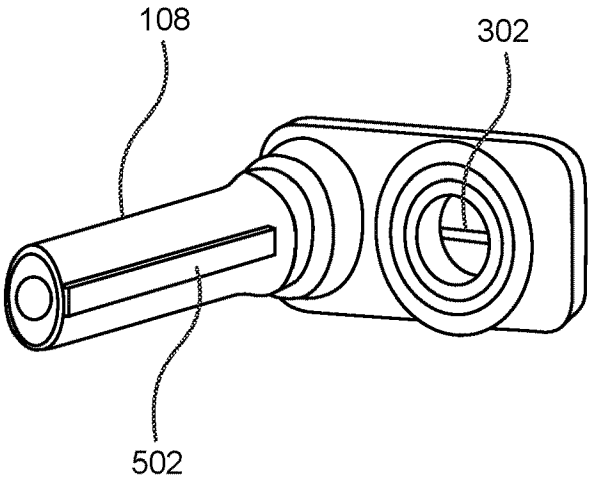
FIGS. 5A, 5B, and 5C show different views of components used adjacent the lid.
Figure 5B:
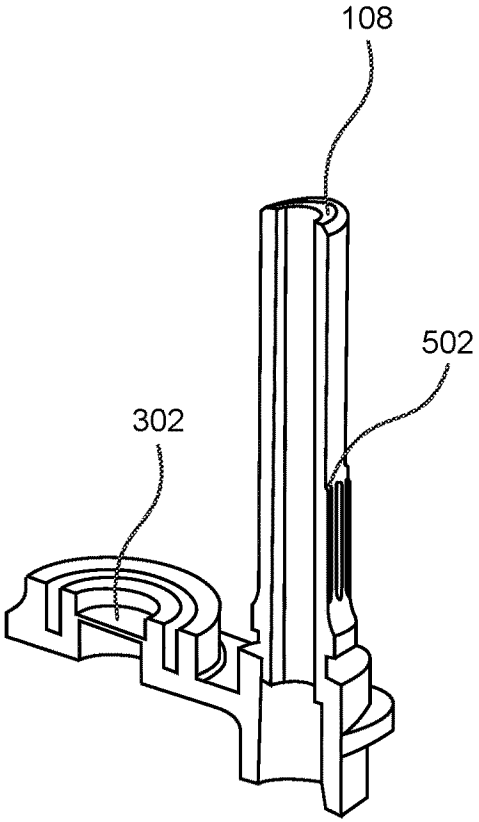
Figure 5A:
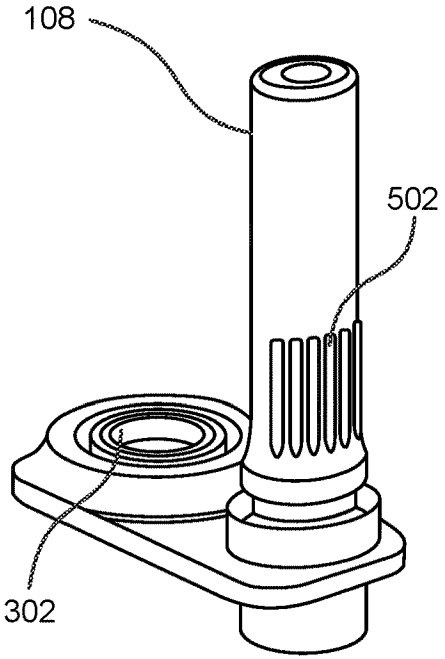

FIGS. 5A-C show different views of components used adjacent the lid, including the straw 108, and the two-way valve 302. These figures also show one or more optional supportive ribs 502. The one or more ribs 502 are arranged to provide structural support to the straw 108 such that when the cap 102 is closed, the straw 108 is urged to bend in a specific and predictable form. Specifically, the one or more ribs 502 urge the straw 108 to bend to fit underneath the cap 102 when it is in a closed position, and also to bend in such a way that the straw 108 itself occludes the flow of any fluid from the container 106.

Figure 6:
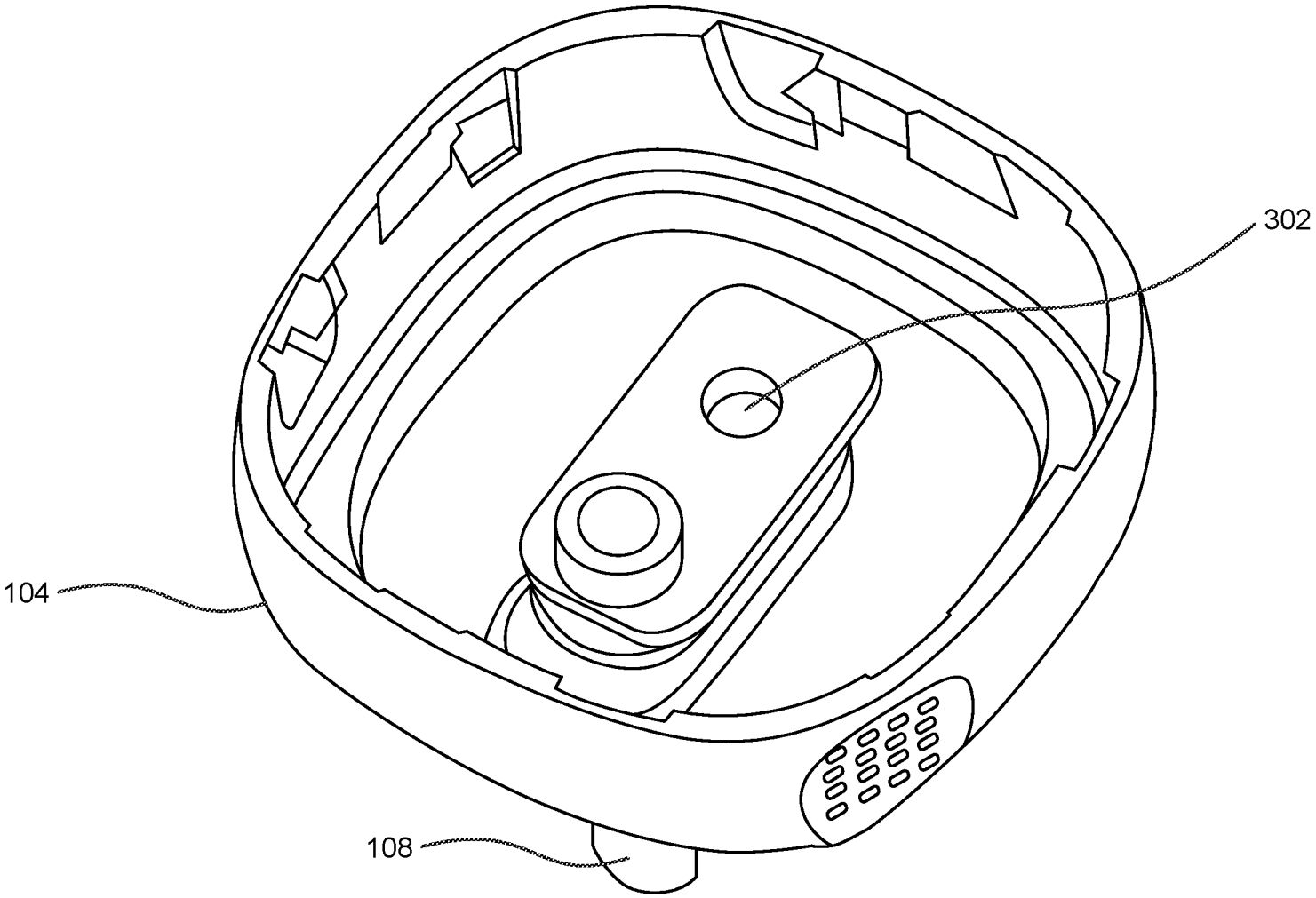
FIG. 6 shows a view from below the lid and adjacent components.

FIG. 6 shows a view from below the lid 104 and the adjacent components, including the straw 108 and the entrance to the two-way valve 302. The lid 104 may comprise a textured portion to enhance the grip of a user.

FIGS. 7A-7C show the cap 102 in two different open positions. In FIG. 7A, there is a shown an open position of the cap 102 such that the angle between the cap 102 and the lid 104 is approximately 24 degrees. The position of the cap 102 can be maintained by a stopper 702 between the cap 102 and the lid 104 which are in rotational communication with each other. The stopper 702 is arranged to allow a discrete range of positions, for example allowing the cap 102 to be held in position every 10 degrees between 0 degrees (which would constitute the closed position) and 180 degrees, as shown in FIG. 7C. The stopper 702 of one embodiment may be ridged to provide a series of "steps" from which the cap 102 may be held in position at any of the available positions as shown in FIG. 7B.

Figure 8B:
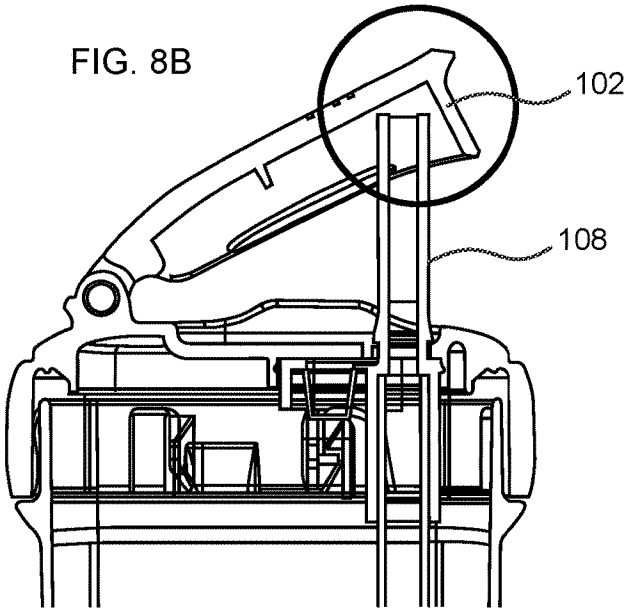
FIGS. 8A-8D show stages of a cap being closed to form a seal within the straw.
Figure 8D:
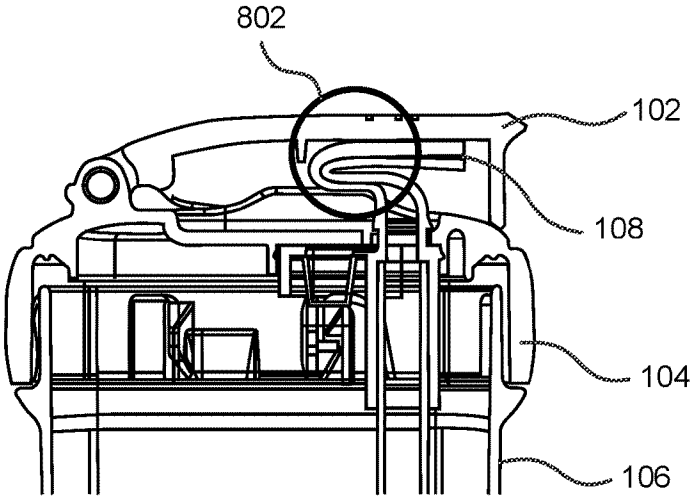
Figure 8A:
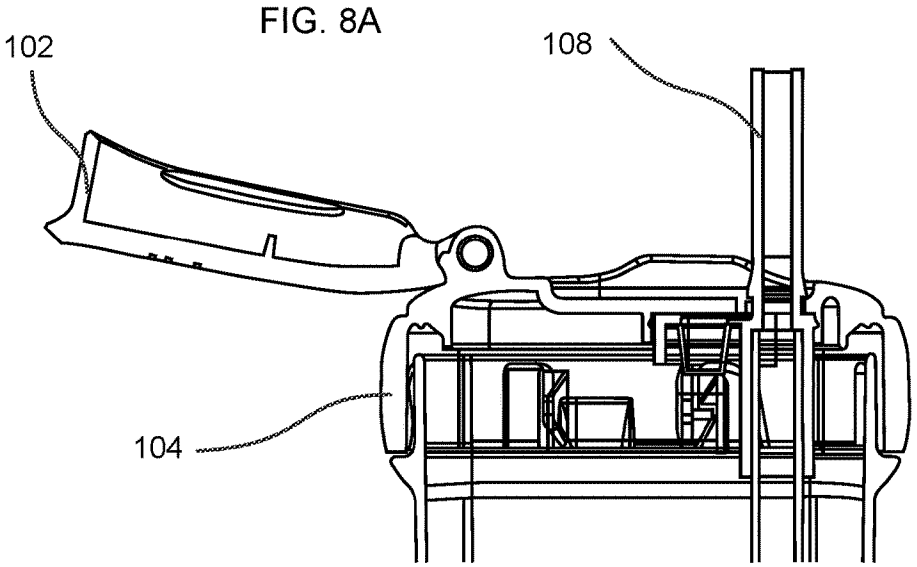
Figure 8C:
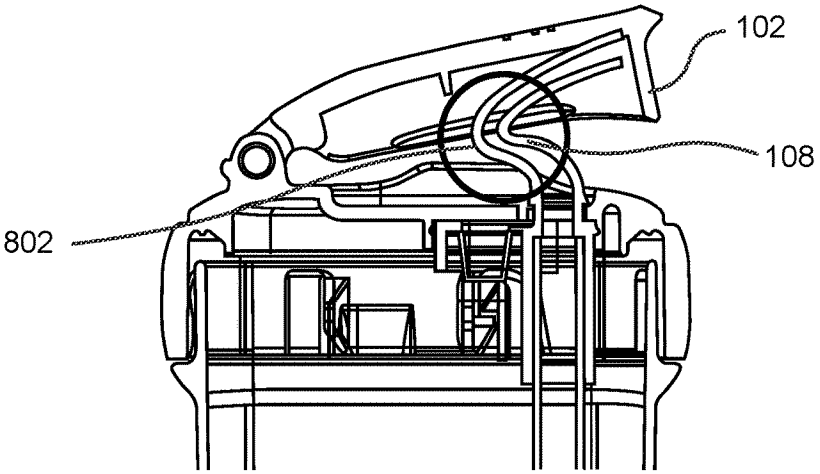

FIGS. 8A-D show four stages of the cap 102 being closed to form a seal within the straw. In the first stage, FIG. 8A, the cap 102 is in an open position and has not yet made physical contact with the straw 108. In FIG. 8B, the cap 102 is still in an open position but has rotated around the lid 104, and is approaching contact with the straw 108. The straw 108 of this embodiment may not be fitted with any supportive ribs, but instead the interior surface of the cap 102 may be shaped in such a way as to urge the straw 108 into the desired shape such as a slope or step to urge the straw to bend forward to a desired position. The interior surface of the cap 102 may comprise an interior wall or other interior surface of the cap 102. When the cap 102 is within a predetermined rotational distance from the lid 104, as shown in FIG. 8C, the straw 108 is urged into a bent position to form a bend 802. This bend 802 restricts the flow of fluid through the straw. When, as in FIG. 8D, the cap 102 is in the closed position adjacent the lid 104, the bend 802 is sufficiently restrictive as to substantially prevent any fluid passing through the straw 108, and as such any liquid in the container 106 is substantially prevented from leaving the drinking vessel via the straw 108.

Figure 9B:
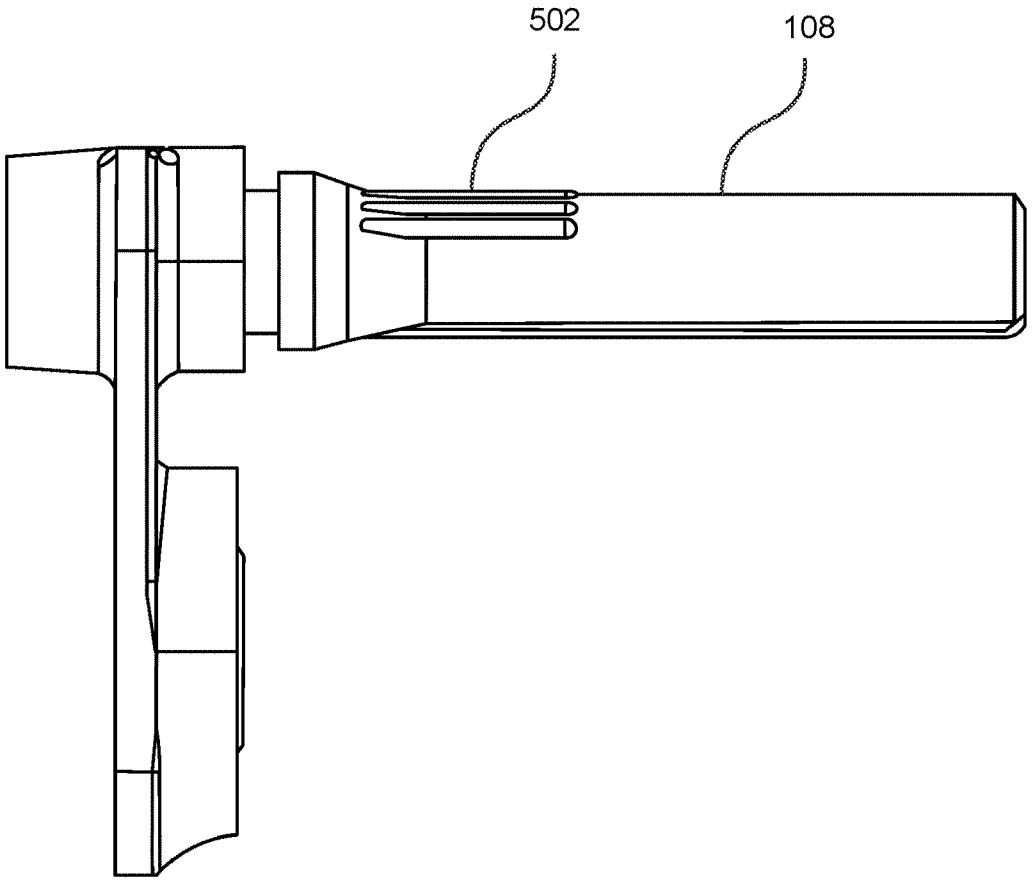
FIGS. 9A and 9B show top and side views of components used adjacent the lid.
Figure 9A:
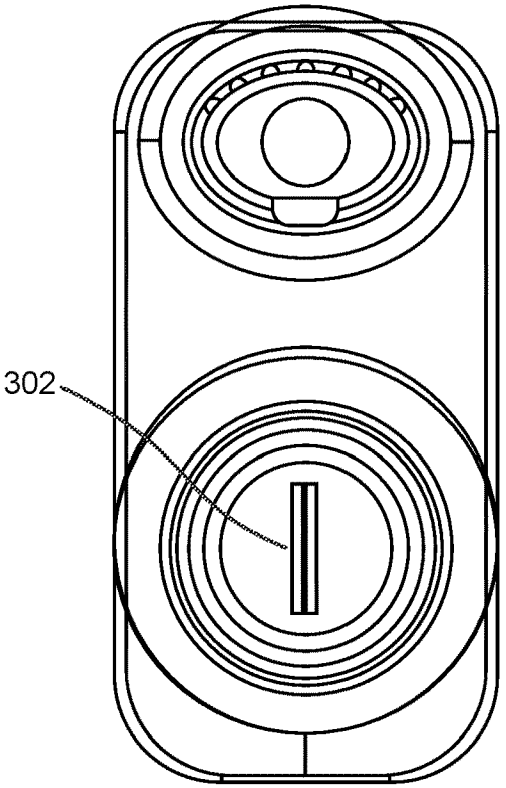

FIGS. 9A and 9B show a top and side view respectively of components used adjacent the lid. In this embodiment, the two-way valve 302 is arranged adjacent the straw 108. The straw 108 may be removed from any surrounding components for the purposes of separate cleaning or replacement. The straw 108 of this embodiment is also supported by a plurality of ribs 502 arranged to urge the straw into a particular configuration when pressure is applied from the cap 102.

Figures 10A, 10B, 10C, 10D, 10E, 10F:
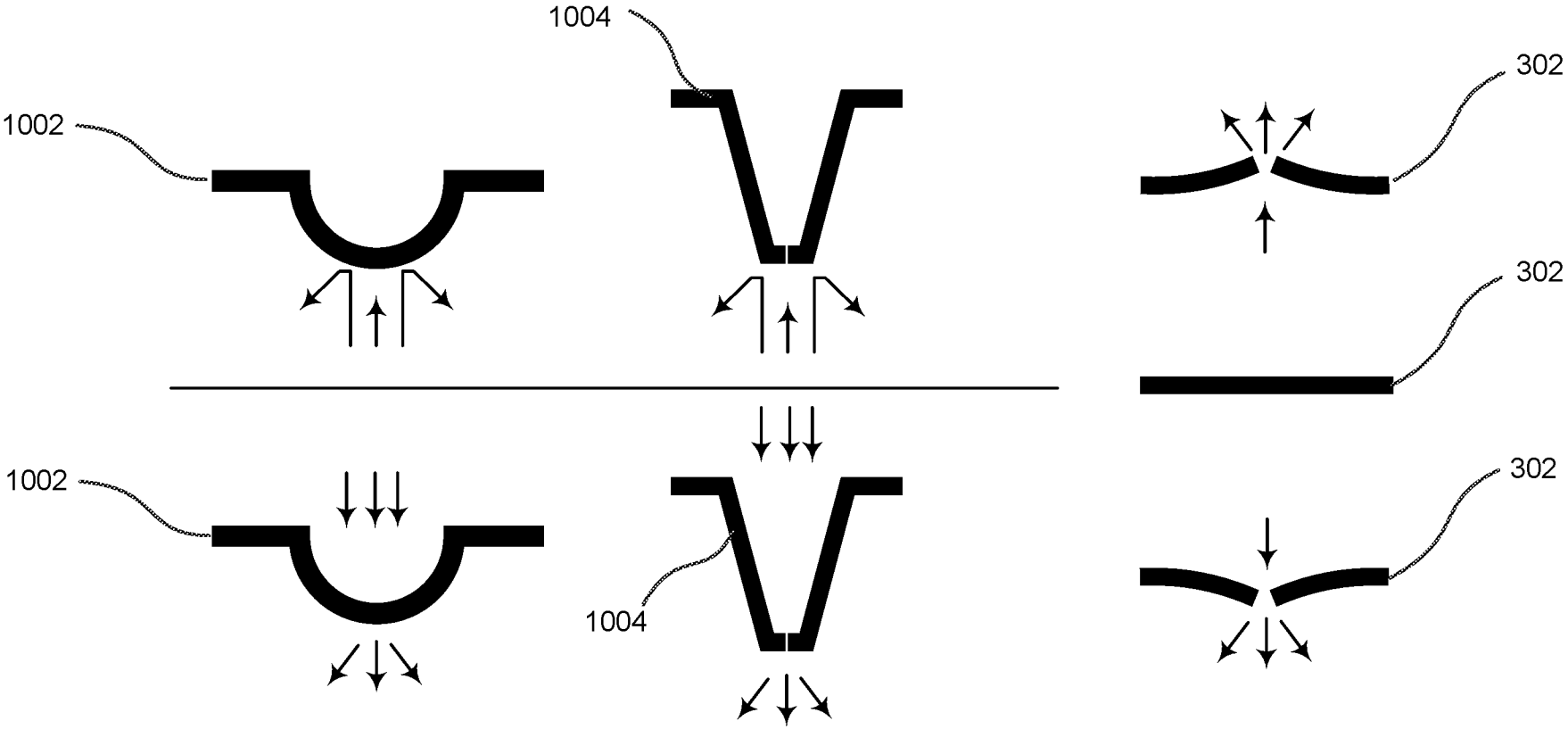
FIGS. 10A-10F show examples of different valves.

FIGS. 10A-F show a more detailed view of how different valves, including the two-way valve 302 may operate under different pressure conditions. FIG. 10A shows a conventional dome shape single way valve 1002. When the pressure within the dome 1002 is greater than the pressure outside the dome 1002, then the material on each side of the slit in the conventional dome shape single way valve 1002 is forced together, preventing the egress of any air and thereby retaining a high pressure zone within the dome 1002 itself. However, as shown in FIG. 10B, when the pressure within the conventional dome shape single way valve 1002 is lower than the pressure outside, then the slit is forced apart and air can pass through the conventional dome shape single way valve 1002 from a zone of higher pressure to a zone of lower pressure.

Similarly, FIGS. 10C and 10D show a conventional duck-bill shape single way valve 1004. When the pressure within the conventional duck-bill shape single way valve 1004 is greater than the pressure outside, then the material on each side of the slit in the valve is forced together, preventing the egress of any air and thereby retaining a high pressure zone within the conventional duck-bill shape single way valve 1004 itself. As shown in FIG. 10D, when the pressure within the conventional duck-bill shape single way valve 1004 is lower than the pressure outside, then the slit is forced apart and air can pass through the conventional duck-bill shape single way valve 1004 from a zone of higher pressure to a zone of lower pressure.

In contrast, the two-way valve 302 of FIGS. 10E and 10F may allow the ingress of air when the pressure on one side of the valve is greater than the other, regardless of the direction in which the pressure differential is being formed. If the pressure on a first side of the two-way valve 302, for example an upper side, is lower than the pressure on a second side, then the material on either side of the slit can part, allowing air to flow from a zone of higher pressure to a zone of lower pressure. Alternatively, if the pressure on that same upper side of the two-way valve 302 is increased, such that the pressure on the first side is now greater than the pressure on the second side, then the material on either side of the slit can again part, allowing air to flow from the zone of higher pressure to the zone of lower pressure.

If the pressure of each side of the two-way valve 302 is equal, then the material on either side of the slit remains close together, and as such provides a substantial barrier to leakage of fluid from the valve.

Figure 11B:
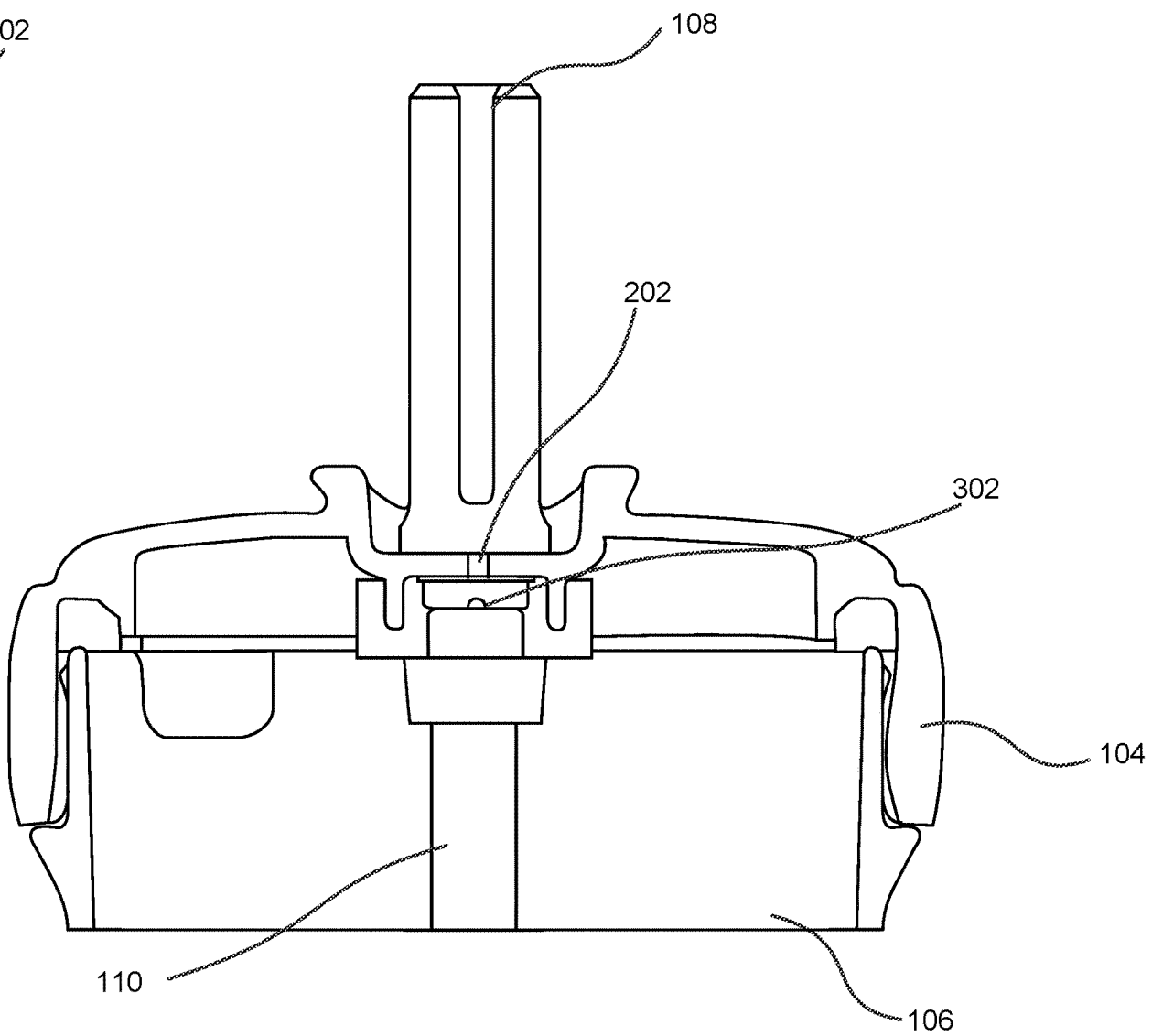
FIGS. 11A and 11B show a cross section across a portion of the drinking vessel.
Figure 11A:
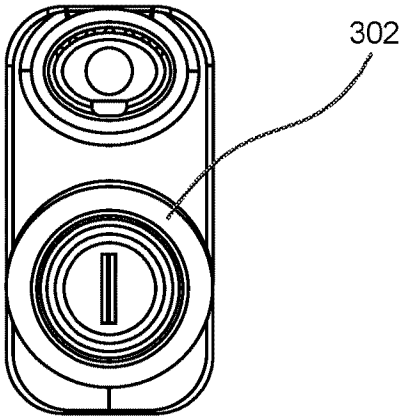

FIGS. 11A and 11B show a cross sectional view across a portion of the drinking vessel. The air venting hole 202 and the two-way valve 302 may be aligned or misaligned provided they are in fluid communication with each other, such that when a zone of lower pressure is created, for example a user drinks a portion of the liquid through the straw 108, air may be sucked through the air venting hole 202 and the two-way valve 302 to equalise the pressure inside the drinking vessel. Conversely, if the pressure inside the drinking vessel is greater than the ambient pressure outside the drinking vessel, then the two-way valve 302 may part to allow air, for example usually hot air, to pass through to the air venting hole 202 and then to the outside environment, thereby equalising the pressure between the inside and outside of the drinking vessel. The material immediately adjacent the slit forming the two-way valve 302 may be ridged at the area where the flat membrane of the value meets the slit.

Figure 12B:
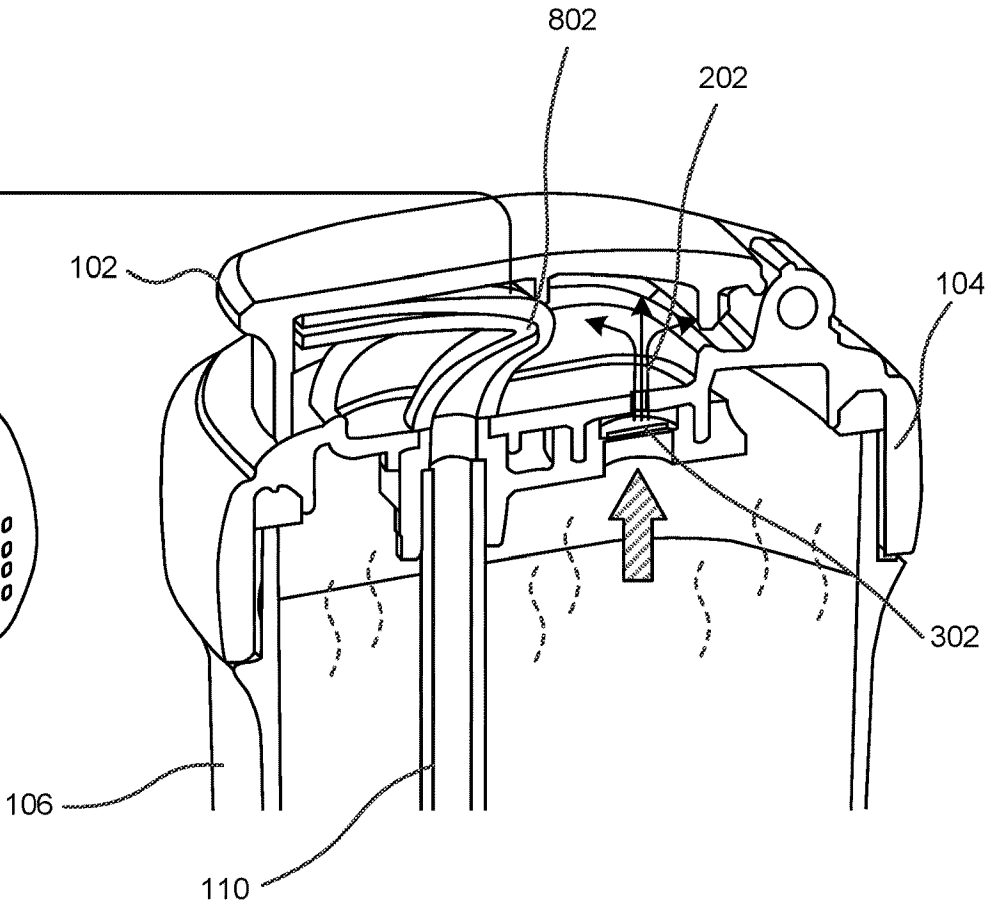
FIGS. 12A and 12B show an internal view of a cap in a closed position.
Figure 12A:
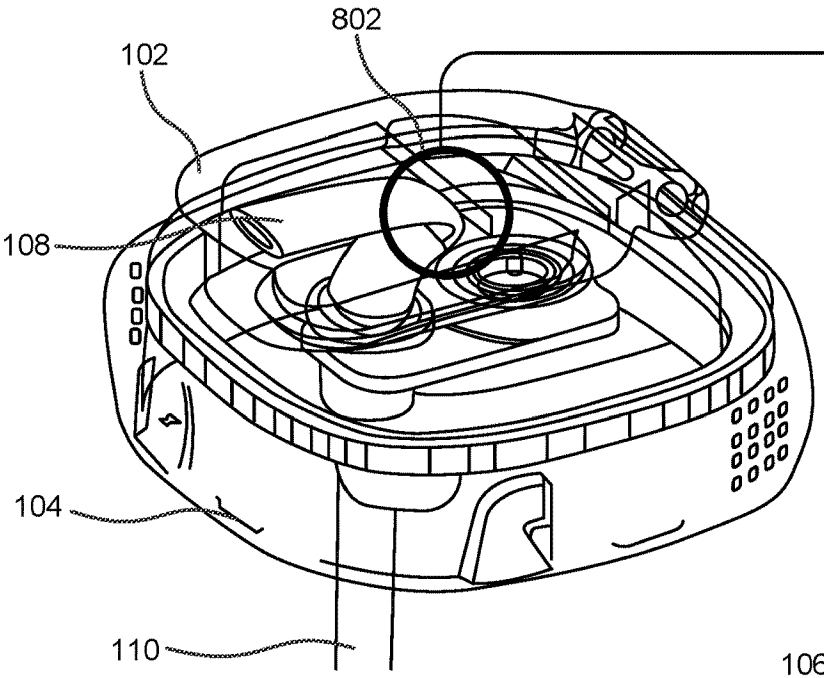

FIGS. 12A and 12B show an internal view of the cap 102 in a closed position. FIG. 12A shows a clear cap 102 for illustration purposes such that the mechanism below may be viewed. At this closure stage, the straw 108 bends to seal the drinking vessel, leaving the two-way valve 302 and the air venting hole 202 as substantially the only means of pressure release. As shown in FIG. 12B, if the drinking vessel is containing warm or hot content during this sealed condition, internal air pressure is likely to be higher than the external environment. In such a case, the two-way valve 302 formed by the flat membrane slit will open outwards to release this higher air pressure out thereby helping to equalise the pressure.

Figure 13B:
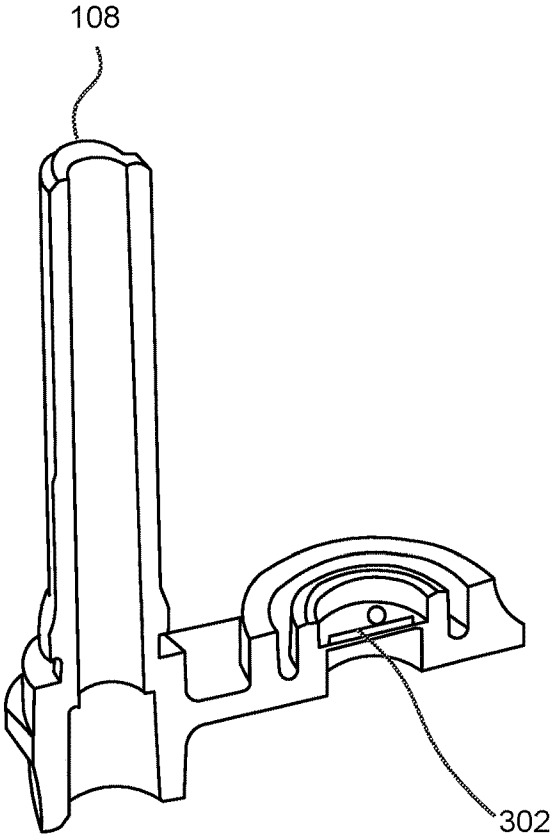
FIGS. 13A and 13B show a cross section of a cap and straw in an open position.
Figure 13A:
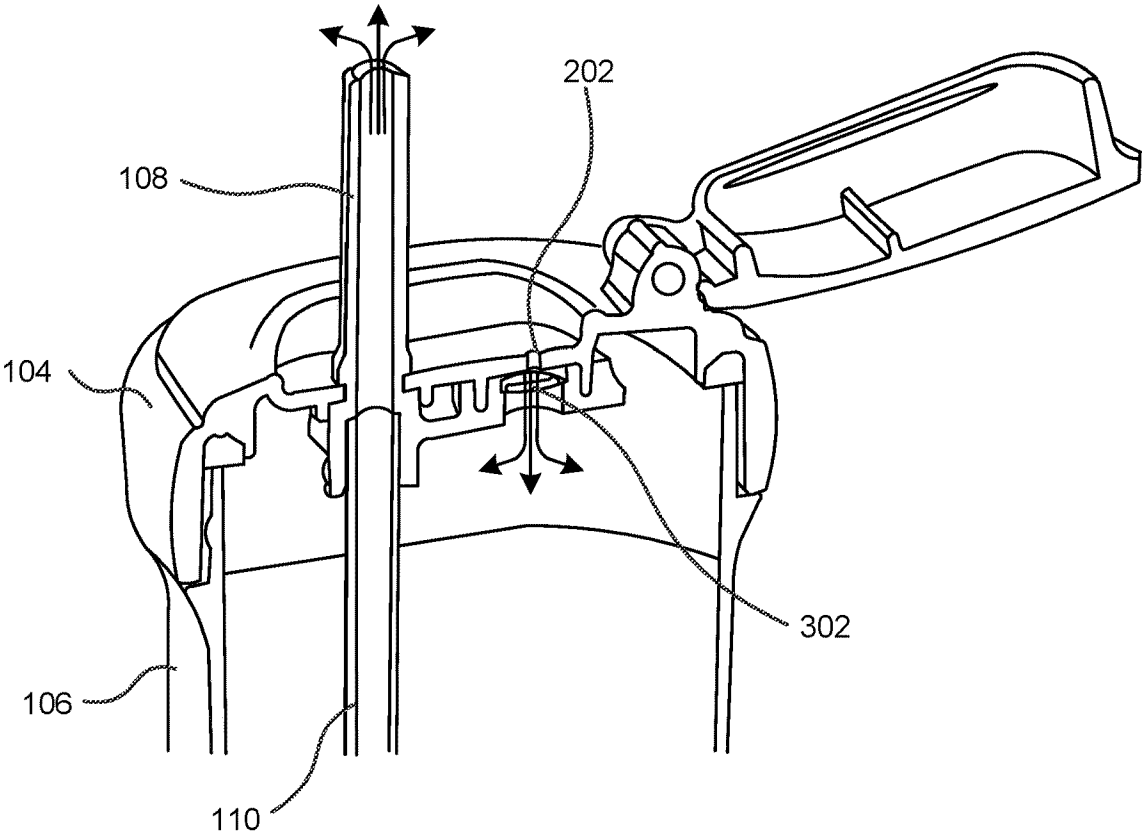

The cross sectional views shown in FIGS. 13A and 13B show a situation in which the pressure outside the drinking vessel is higher than the pressure inside. Such a case may arise when a user, for example a child, is sucking out the content of the drinking vessel through the straw 108. In such a case, the internal pressure will drop, potentially to a vacuum. The two-way valve 302 will therefore open inwards as the external ambient pressure outside the drinking vessel becomes at least momentarily higher than that inside the drinking vessel. The opening of the two-way valve 302 allows for air to enter the drinking vessel, thereby equalising the pressure.

Figure 14B:
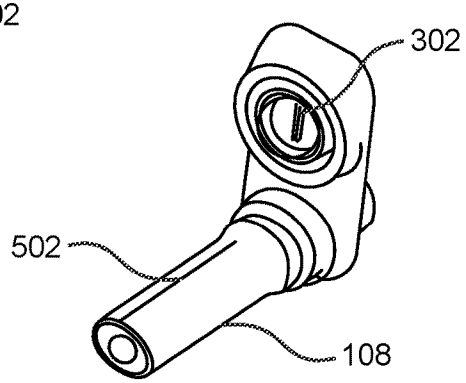
FIGS. 14A-14E show a cap making contact with a straw
Figure 14A:
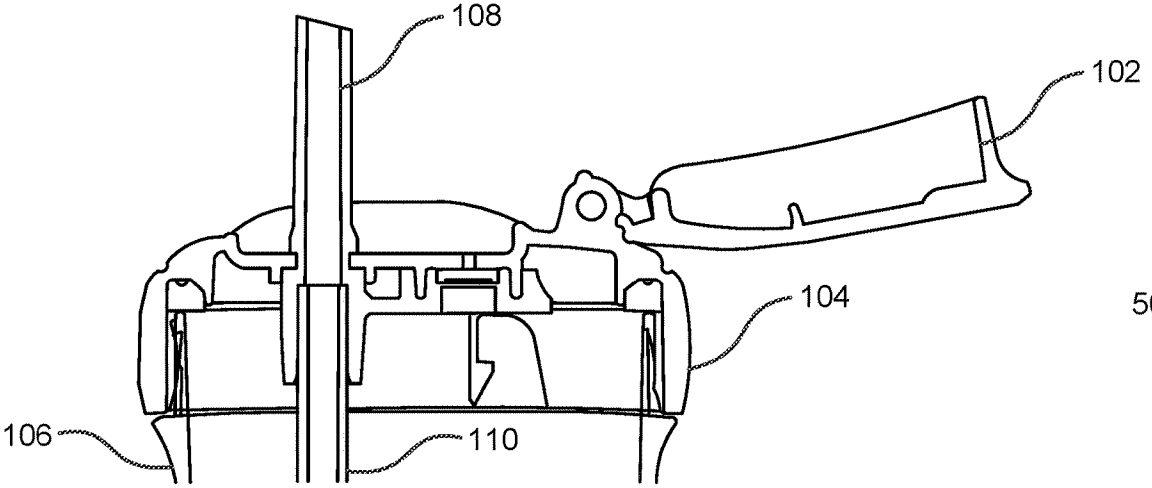
Figure 14E:
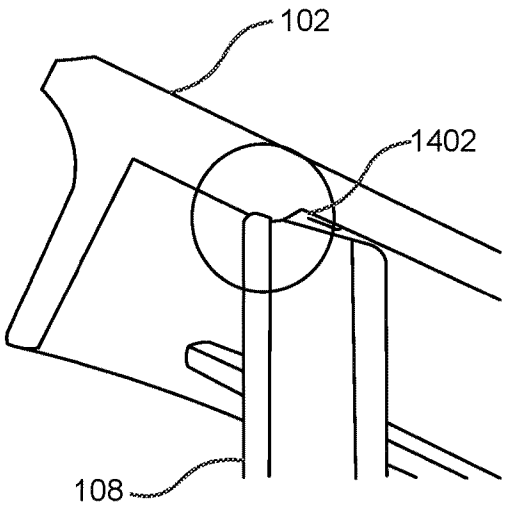
Figure 14D:
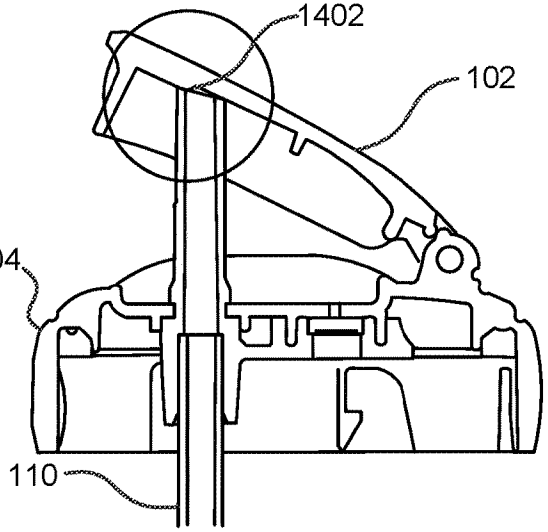
Figure 14C:
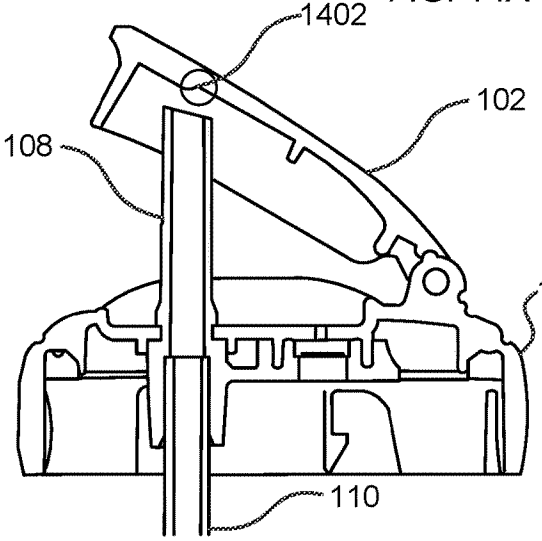

FIGS. 14A-14E show a cap 102 interacting with a straw 108. In FIG. 14A, the cap 102 is in an open position, and so is not in physical contact with the straw 108. An isolated view of the straw 108 alongside the venting valve 302 and a rib 502 is shown in FIG. 14B. In FIG. 14C, the cap 102 has been partially closed, demonstrating in this embodiment a shoulder 1402 of the inner surface of the cap 102 which is in close proximity to the straw 108. In FIG. 14D, as the cap 102 closes further, the shoulder 1402 contacts the straw 108, a closer view of which is shown in FIG. 14E.

Figure 15C:
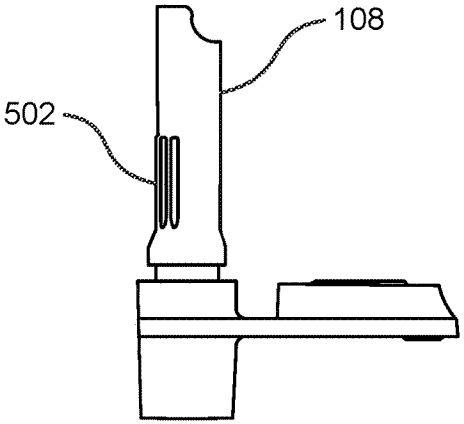
FIGS. 15A-15F show different embodiments of the straw.
Figure 15F:
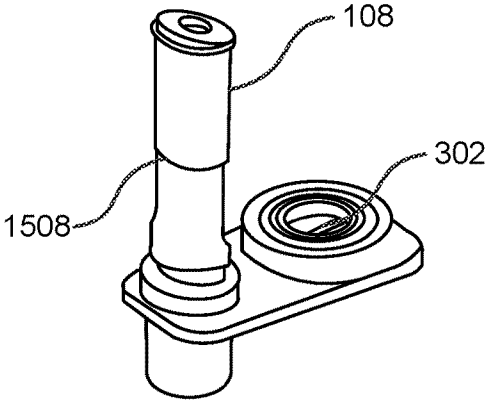
Figure 15B:
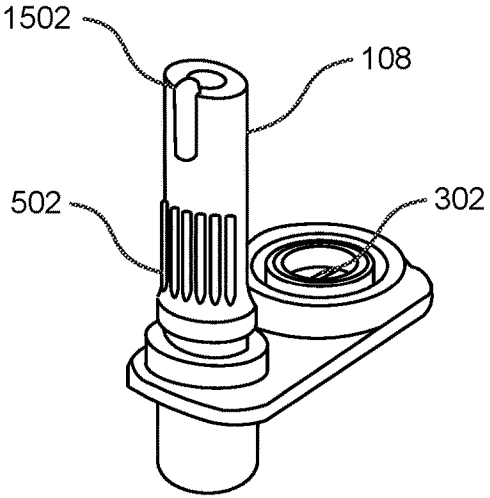
Figure 15E:
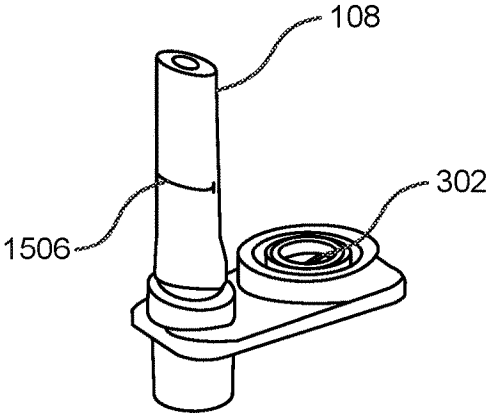
Figure 15A:
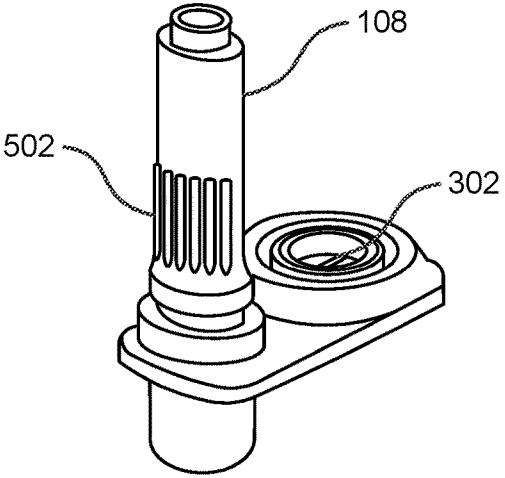
Figure 15D:
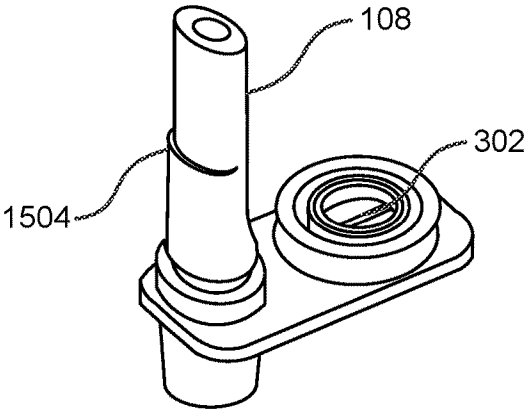
Figure 16A:
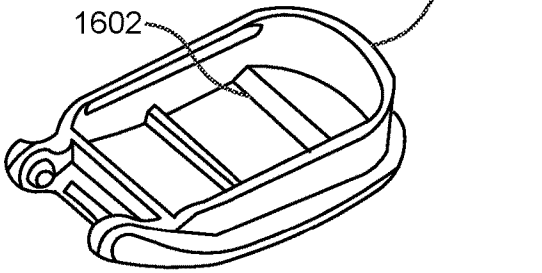
FIGS. 16A-16F show different embodiments of the cap.
Figure 16B:
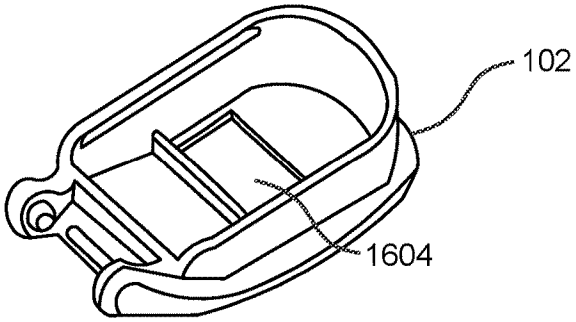
Figure 16C:
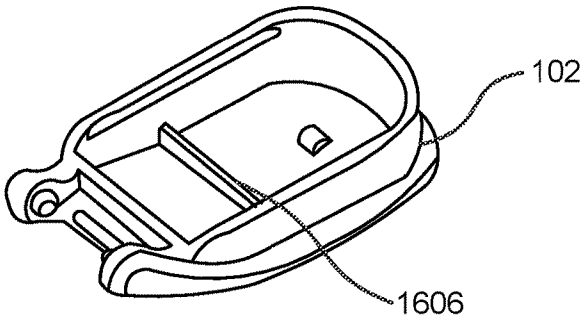
Figure 16D:
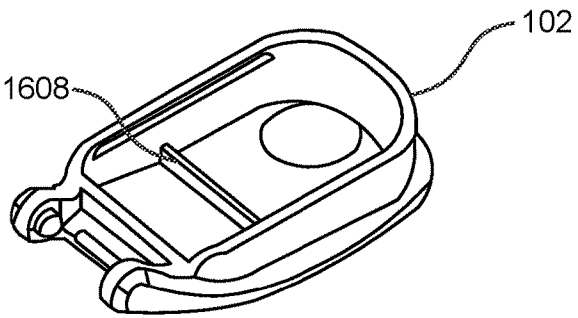
Figure 16E:
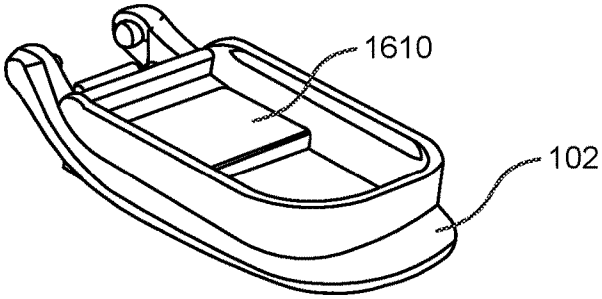
Figure 16F:
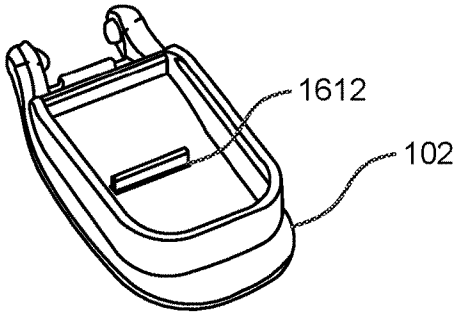

The straw 108 may itself comprise features which contribute towards the urging of the straw 108 into a predetermined desired bent shape. These features may comprise the multiple ribs 502 of FIGS. 15A and 15B, optionally further comprising the cut-out groove 1502 at one end of the straw 108 as shown in FIGS. 15B and 15C. As shown in FIGS. 15D-F, the straw 108 may further comprise a shelf or ledge 1504, a score mark 1506, and/or a thicker portion 1508. Any or each of these features may provide the advantage of assisting with urging the straw 108 into a predetermined desired bent shape and/or providing a reinforcement feature to help the straw bounce back to its un-bent shape.

FIGS. 16A-F show a range of different inside faces of the cap 102 which may be used. These faces include a ledge 1602, a rectangular recess 1604, a smaller ledge 1606, a protruded dome 1608, a shoulder 1610, and an off-centre ledge 1612, also referred to as an island ledge 1612. Any of these features may be used to assist the straw to be bent when in contact with said features either individually or in combination.

Any reference to 'an' item refers to one or more of those items. The term 'comprising' is used herein to mean including the method blocks or elements identified, but that such blocks or elements do not comprise an exclusive list and an apparatus may contain additional blocks or elements and a method may contain additional operations or elements. Furthermore, the blocks, elements and operations are themselves not impliedly closed.

The steps of the methods described herein may be carried out in any suitable order, or simultaneously where appropriate. The arrows between boxes in the figures show one example sequence of method steps but are not intended to exclude other sequences or the performance of multiple steps in parallel. Additionally, individual blocks may be deleted from any of the methods without departing from the spirit and scope of the subject matter described herein. Aspects of any of the examples described above may be combined with aspects of any of the other examples described to form further examples without losing the effect sought. Where elements of the figures are shown connected by arrows, it will be appreciated that these arrows show just one example flow of communications (including data and control messages) between elements. The flow between elements may be in either direction or in both directions.

Where the description has explicitly disclosed in isolation some individual features, any apparent combination of two or more such features is considered also to be disclosed, to the extent that such features or combinations are apparent and capable of being carried out based on the present specification as a whole in the light of the common general knowledge of a person skilled in the art, irrespective of whether such features or combinations of features solve any problems disclosed herein. In view of the foregoing description it will be evident to a person skilled in the art that various modifications may be made within the scope of the invention.

The invention claimed is:

1. A drinking vessel, comprising:

a straw;

a lid comprising an opening operable to receive the straw;

a container;

a cap operable to be in an open position or a closed position; and a two-way valve, wherein when the cap is in the open position, the straw is arranged to provide fluid communication between a user and the container through the lid, wherein when the cap is in the closed position, the straw is urged by the cap into a bent shape such that the straw itself occludes fluid communication; and wherein the two-way valve is configured to allow an ingress or an egress of air between the inside and outside of the container when there is an applied pressure differential.

2. The drinking vessel of claim 1, wherein the two-way valve comprises a slit cut into a resilient base material, such that when the pressure on each side of the slit is equal, the base material on each side of the slit meets to form a seal; and when the pressure on each side of the slit is unequal, the base material on each side of the slit is urged apart to allow fluid transmission.

3. The drinking vessel of claim 2, wherein at least a portion of the two-way valve is made of silicone.

4. The drinking vessel of claim 1, wherein the straw comprises one or more structural supports.

5. The drinking vessel of claim 4, wherein the one or more structural supports are orientated to urge the straw into the bent shape when pressure is applied from the cap.

6. The drinking vessel of claim 1, wherein the cap has an interior and an exterior surface, and further wherein the interior surface is shaped to urge the straw into the bent shape.

7. The drinking vessel of claim 1, wherein the open position comprises a set of different positions.

8. The drinking vessel of claim 1, wherein at least a portion of the straw is made of an elastomer.

9. The drinking vessel of claim 1, further comprising a seal between the lid and the container.

10. The drinking vessel of claim 1, further comprising a lower straw between the lid and the container.

11. The drinking vessel of claim 10, wherein at least a portion of the lower straw and/or seal is made of an elastomer.

12. The drinking vessel of claim 1, wherein at least a portion of the cap and/or lid is made of a thermoplastic.

13. The drinking vessel of claim 1, wherein at least a portion of the container is made of a thermoplastic.

14. The drinking vessel of claim 1, wherein the two-way valve is adjacent to the straw.

15. A two-way valve for use in a drinking vessel, comprising a slit cut into a resilient base material, such that when the pressure on each side of the slit is equal, the base material on each side of the slit meets to form a seal; and when the pressure on each side of the slit is unequal, the base material on each side of the slit is urged apart to allow fluid transmission, and wherein the two-way valve is configured to allow an ingress or an egress of fluid between the inside and outside of the drinking vessel when there is an applied pressure differential.

16. The two-way valve of claim 15, wherein at least a portion of the two-way valve is made of silicone.

* * * * *